US012098901B2

(12) United States Patent
Axelsson

(10) Patent No.: US 12,098,901 B2
(45) **Date of Patent: *Sep. 24, 2024**

(54) GAS-POWERED GUN

(71) Applicant: FX Airguns AB, Mariestad (SE)

(72) Inventor: Fredrik Axelsson, Mariestad (SE)

(73) Assignee: FX AIRGUNS AB, Mariestad (SE)

( * ) Notice: Subject to any disclaimer, the term of this patent is extended or adjusted under 35 U.S.C. 154(b) by 0 days.

This patent is subject to a terminal disclaimer.

(21) Appl. No.: 18/640,348

(22) Filed: Apr. 19, 2024

(65) Prior Publication Data

US 2024/0263912 A1 Aug. 8, 2024

Related U.S. Application Data

(63) Continuation-in-part of application No. 18/388,979, filed on Nov. 13, 2023.

(30) Foreign Application Priority Data

Nov. 14, 2022 (EP) ..... 22207183

(51) Int. Cl.
*F41B 11/723* (2013.01)
*F41B 11/62* (2013.01)
*F41B 11/73* (2013.01)

(52) U.S. Cl.
CPC ..... *F41B 11/62* (2013.01); *F41B 11/723* (2013.01); *F41B 11/73* (2013.01)

(58) Field of Classification Search
CPC F41B 11/52; F41B 11/62; F41B 11/60; F41B 11/723; F41B 11/73
USPC ..... 124/50, 75
See application file for complete search history.

(56) References Cited

U.S. PATENT DOCUMENTS

| | | | | |
|---|---|---|---|---|
| 2,634,717 A | | 4/1953 | Junkin | |
| 4,951,644 A | * | 8/1990 | Bon | F41B 11/723 124/75 |
| 5,542,406 A | * | 8/1996 | Oneto | F41B 11/62 124/71 |
| 5,967,133 A | * | 10/1999 | Gardner, Jr. | F41B 11/52 124/32 |
| 6,349,711 B1 | * | 2/2002 | Perry | F41B 11/723 124/73 |
| 6,637,421 B2 | * | 10/2003 | Smith | F41B 11/52 124/32 |

(Continued)

FOREIGN PATENT DOCUMENTS

| | | |
|---|---|---|
| EP | 0140657 A1 | 5/1985 |
| GB | 2427671 A | 1/2007 |

OTHER PUBLICATIONS

Extended European Search Report dated May 9, 2023 issued by the European Patent Office in corresponding European Patent Application No. 22207183.9 (7 Pages).

*Primary Examiner* — Michael D David
(74) *Attorney, Agent, or Firm* — Panitch Schwarze Belisario & Nadel LLP

(57) ABSTRACT

A gas-powered gun for discharge of projectiles, comprising a pressure chamber for holding compressed gas, a valve arranged to release compressed gas from the pressure chamber to thereby discharge a projectile provided in a barrel, and a plenum chamber in fluid connection with the pressure chamber. The plenum chamber is formed coaxially around a rear portion of the barrel.

22 Claims, 3 Drawing Sheets

(56) References Cited

U.S. PATENT DOCUMENTS 6,644,295 B2 * 11/2003 Jones ..... F41B 11/721 124/75
6,644,296 B2 * 11/2003 Gardner, Jr. ..... F41B 11/724 124/56
6,675,791 B1 * 1/2004 Alexander ..... F41B 11/724 124/71
6,889,681 B1 * 5/2005 Alexander ..... F41B 11/724 124/72
7,044,119 B2 * 5/2006 Jones ..... F41B 11/721 124/74
7,237,544 B2 * 7/2007 Jones ..... F41B 11/57 124/73
7,461,646 B2 * 12/2008 Jones ..... F41B 11/721 42/69.02
7,556,032 B2 * 7/2009 Jones ..... F41B 11/00 124/73
7,591,262 B2 * 9/2009 Jones ..... F41B 11/73 124/82
7,617,819 B2 * 11/2009 Jones ..... F41B 11/73 124/74
7,624,723 B2 * 12/2009 Gardner, Jr. ..... F41A 19/58 124/56
7,640,925 B2 * 1/2010 Jones ..... F41B 11/721 124/73
7,866,308 B2 * 1/2011 Jones ..... F41B 11/00 124/71
7,913,679 B2 * 3/2011 Quinn ..... F41B 11/722 124/77
8,082,912 B2 * 12/2011 Wood ..... F41B 11/721 124/77
9,080,832 B2 * 7/2015 Brahler ..... F41H 13/0006
9,649,897 B2 * 5/2017 Kunau ..... B60C 25/145
9,700,779 B1 * 7/2017 Leal ..... F41B 11/80
10,266,019 B2 * 4/2019 Kunau ..... B60C 25/138
10,800,216 B2 * 10/2020 Kunau ..... B60C 25/145
11,079,037 B2 * 8/2021 Kunau ..... F16K 31/383
11,273,677 B2 * 3/2022 Huang ..... F16K 31/1221
2019/0107359 A1 4/2019 Rotrekl et al.

* cited by examiner

GAS-POWERED GUN

FIELD OF THE INVENTION

The present invention relates to a gas-powered gun comprising a pressure chamber for holding compressed gas, a valve arranged to release compressed gas from the pressure chamber to thereby discharge a projectile provided in a barrel, and a plenum chamber in fluid connection with the pressure chamber.

BACKGROUND ART

Gas powered guns of the above-mentioned kind are well known in the art, and the compressed gas may be e.g. air (air guns). The "plenum" can be seen as an extension of the pressure chamber, so that more pressurized air is available to discharge a bullet when the trigger is pulled. The size of the plenum is critical for the performance of the gun, and various add-on devices are available to provide an increased plenum size. However, such add-on plenum devices tend to be impractical.

Document GB 2427671 discloses an air gun having a pressure tank arranged around the barrel. As will be understood by the skilled person, a tank is not a plenum. Indeed, the air gun in GB 2427671 does not have any plenum.

SUMMARY OF THE INVENTION

In view of that stated above, the object of the present invention is to provide a gas-powered gun with an improved plenum size. Specifically, it is desirable to have a larger plenum without any add-on device.

This and other objects are achieved by a gas-powered gun of the kind mentioned above, wherein the plenum chamber is formed around at least a rear portion of the barrel. In some embodiments, the plenum chamber is formed coaxial with the barrel.

Such an arrangement of the plenum allows an increased plenum size without requiring any additional components or increasing the size of the gun. The plenum may be formed by a sleeve arranged coaxially around the barrel, and provided with sealings in either end (front and rear). The rear sealing can then be provided with a passage for connecting the plenum with the pressure chamber.

It is noted that sleeves arranged coaxially around the barrel of a gun are known per se. Conventionally, such sleeves are provided to protect a user from the barrel, which may become very hot during use. Such conventional sleeves are however not sealed, and are also not designed to withstand high pressure.

BRIEF DESCRIPTION OF THE DRAWINGS

Currently preferred embodiments of the present invention will be described herein with reference to the following figures.

The invention may however, be embodied in many different forms and should not be construed as limited to the embodiments set forth herein; rather, these embodiments are provided for thoroughness and completeness, and fully convey the scope of the invention to the skilled person. All the figures are highly schematic, not necessarily to scale, and they show only parts which are necessary in order to elucidate the invention, other parts being omitted or merely suggested.

DETAILED DESCRIPTION OF CURRENTLY PREFERRED EMBODIMENTS

Figure 1:
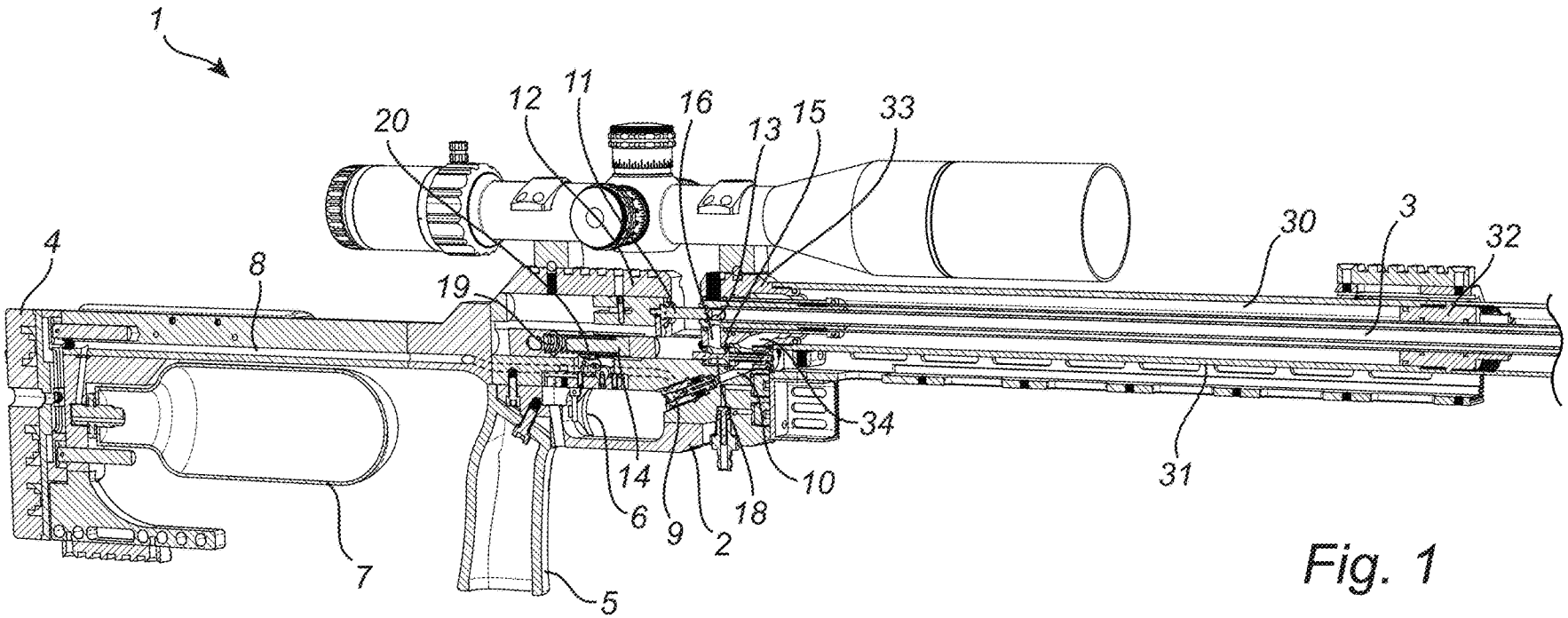
FIG. 1 shows an air gun according to an embodiment of the present invention.
Figure 2A:
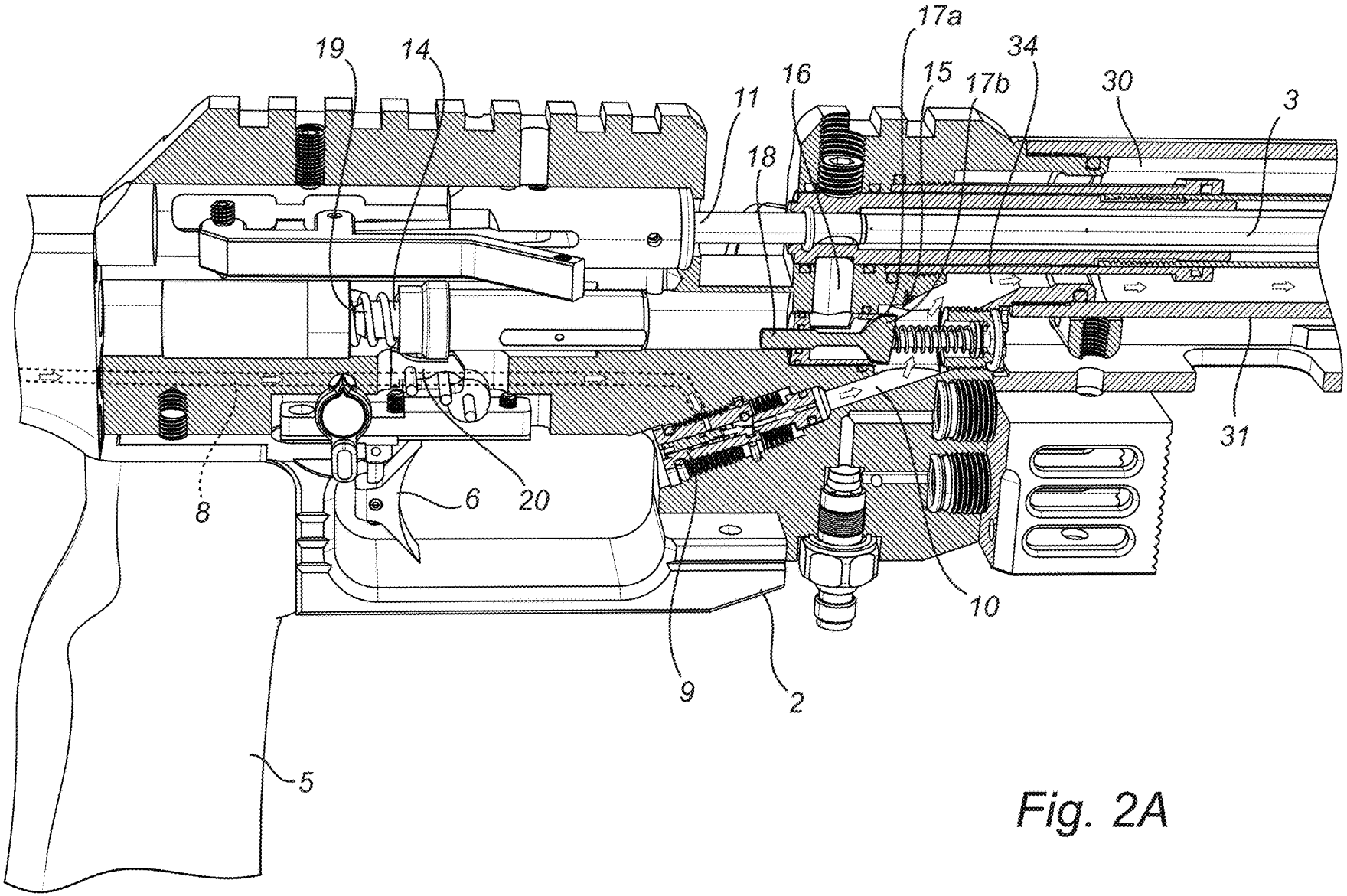
FIG. 2A-2B shows the gun in FIG. 1 in a loaded, ready-to-fire state and in a state of firing.
Figure 2B:
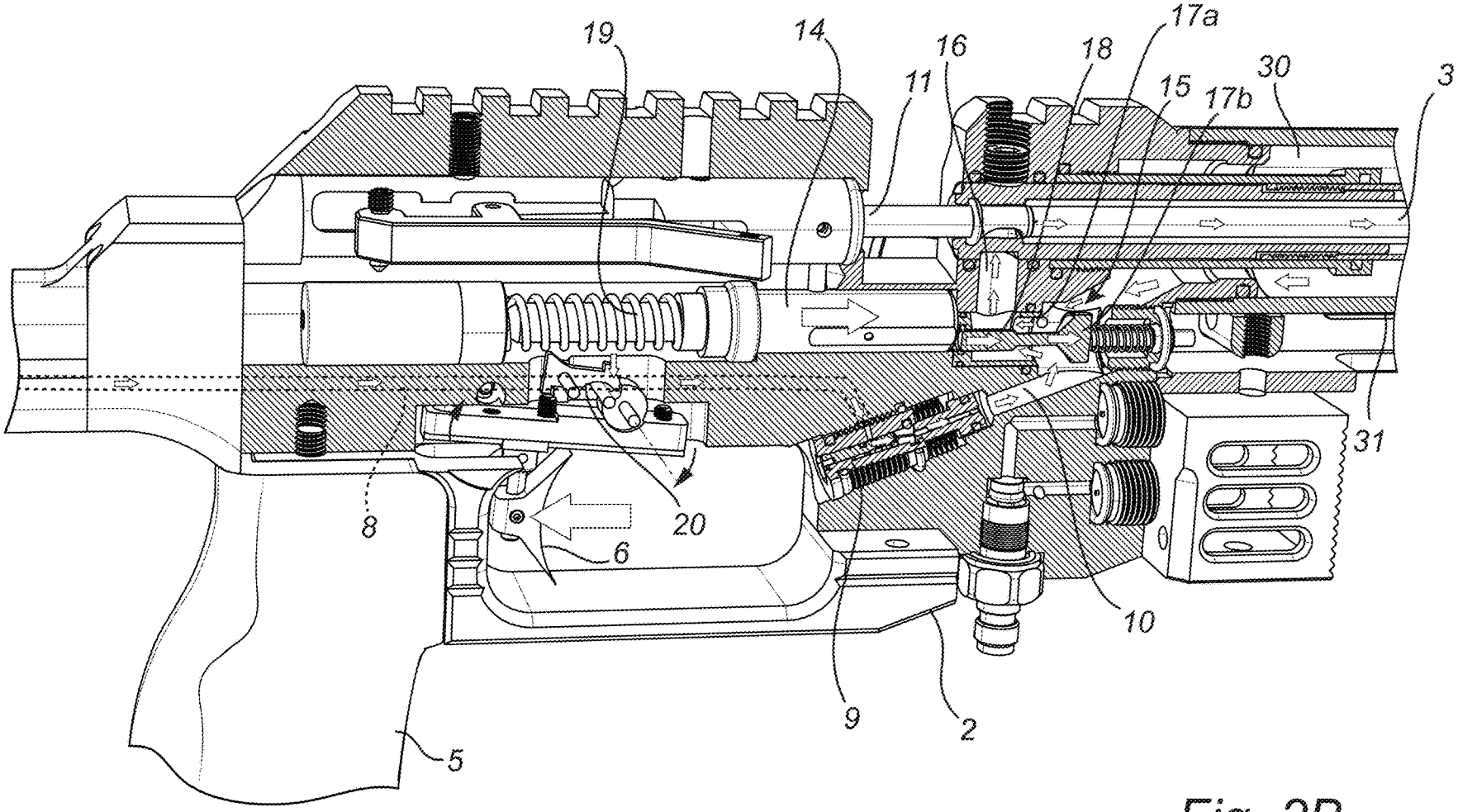

FIGS. 1 and 2A-2B show a gas-powered gun 1, generally including a body 2, a barrel 3, a stock 4 and a handle 5 with a trigger 6. The gun 1 is of the kind where a bottle 7 of compressed gas, such as air, is fitted to the gun 1. In the illustrated example the bottle 7 is fitted to the stock 4, but it may also be fitted to the body 2, in front of the handle.

Via a channel 8 and a pressure regulator 9 the bottle 7 is in fluid connection with a pressure chamber 10. The pressure regulator 9 ensures a controlled pressure in the pressure chamber 10 (regulated pressure).

The gun 1 further comprises a feeder pin 11 slidably arranged in a housing 12 behind the barrel 3. The feeder pin 11 is arranged to be slid back, into a rearwards position, thereby allowing a bullet (projectile) 13 to be inserted in a space in front of the feeder pin 11. The feeder pin 11 is then slid forward, to a forwards position, thereby pushing the bullet 13 into a firing position in the barrel 3, as shown in FIG. 2A. In this position, the bullet is ready to be discharged, when pressurized air from the pressure chamber and plenum is allowed to enter the barrel. The bullet 13 may 13 may be provided manually, or from some type of cartridge or magazine (not shown).

The trigger 6 is mechanically connected to a spring-loaded hammer 14, which operates an open-close valve 15, which connects the pressure chamber 10 to a space 16 immediately behind the bullet in the firing position. The valve 15 includes a valve-seat 17*a* forming an opening of the pressure chamber 10, and a valve-head 17*b* arranged inside the pressure chamber and being pressed against the valve-seat 16 to seal the chamber 10. The valve-head 17*a* has a hammer cooperating portion 18 extending rearwards through the opening, so that it can be engaged by the hammer 14.

When the gun is in a loaded position (FIG. 2A) the hammer 14 is biased towards the valve 15 by a biasing spring 19, and is held against the force of the biasing spring 19 by a catch 20. At the moment of firing (FIG. 2B), the trigger 6 releases the catch 20 and the hammer 14 is pushed into contact with the portion 18, thereby opening the valve 15. Compressed gas is now allowed to enter the space 16 and discharge the bullet 13.

According to the present invention, the pressure chamber 10 is in fluid connection with a larger chamber 30, referred to as a plenum chamber, or simply plenum. The plenum thus forms an extension of the pressure chamber, and the pressure in the plenum is also regulated by the regulator 9. The plenum 30 is formed around a rear portion of the barrel 3, here coaxially surrounding the barrel 3.

In the illustrated example, the plenum 30 is formed by a sleeve 31 surrounding the barrel 3, and being sealed in each end by a front sealing 32 and a rear sealing 33. The rear sealing 33 is formed with a passage 34 providing a fluid connection between the coaxial plenum 30 and the pressure chamber 10.

The sleeve 30 and sealings 32, 33 are designed to withstand the regulated pressure. The walls of the sleeve 30 may therefore have a greater thickness than conventional barrel sleeves. As an example, the walls may have a thickness of around 3 mm.

It will be appreciated that the present invention is not limited to the embodiments shown. Several modifications and variations are thus conceivable within the scope of the invention which thus is exclusively defined by the appended claims.

What is claimed is:

1. A gas-powered gun for discharge of projectiles, comprising:

a barrel;

a pressure chamber for holding compressed gas;

a valve arranged to release compressed gas from the pressure chamber to thereby discharge a projectile provided in the barrel; and a plenum chamber in fluid connection with the pressure chamber, wherein the plenum chamber is formed around at least a rear portion of said barrel, and wherein the pressure chamber is in fluid connection with a source of pressurized air via a pressure regulator, said pressure regulator providing a controlled pressure in the pressure chamber and the plenum chamber.

2. The gas-powered gun according to claim 1, wherein the plenum is formed coaxially around the barrel.

3. The gas-powered gun according to claim 1, wherein the plenum is formed by a sleeve surrounding the barrel, said sleeve being sealed in either end by a front sealing and a rear sealing, said rear sealing formed with a passage providing a fluid connection between the plenum and the pressure chamber.

4. The gas-powered gun according to claim 3, wherein the sleeve is arranged coaxially around the barrel.

5. The gas-powered gun according to claim 1, wherein the plenum forms an extension of the pressure chamber, and wherein a pressure in both the plenum and the pressure chamber is regulated by a pressure regulator.

6. The gas-powered gun according to claim 1, wherein a source of pressurized air is a bottle containing compressed air which has been fitted to the gas-powered gun.

7. The gas-powered gun according to claim 1, further comprising an open-close valve connecting the pressure chamber to a space immediately behind a firing position in the barrel.

8. The gas-powered gun according to claim 7, further comprising a trigger which is mechanically connected to a spring-loaded hammer, which hammer is configured operates the open-close valve.

9. The gas-powered gun according to claim 7, wherein the hammer is biased towards the open-close valve by a biasing spring, and is held against the force of the biasing spring by a catch, and wherein the trigger is operable to release the catch.

10. The gas-powered gun according to claim 7, further comprising a feeder pin arranged in a housing behind the barrel, said feeder pin being operable between a rearwards position, in which it allows a bullet to be inserted in a space in front of the feeder pin, and a forwards position in which it pushes the bullet into the firing position.

11. The gas-powered gun according to claim 3, wherein walls of the sleeve have a thickness of around 3 mm.

12. A gas-powered gun for discharge of projectiles, comprising:

a barrel;

a pressure chamber for holding compressed gas;

a plenum chamber in fluid connection with the pressure chamber, thereby forming an extension of the pressure chamber;

a pressure regulator connecting the pressure chamber and the plenum chamber with a source of pressurized air, said pressure regulator arranged to maintain a regulated pressure in the pressure chamber and the plenum chamber;

a valve arranged to release compressed gas from the pressure chamber and plenum chamber into the barrel, to thereby discharge a bullet provided in the barrel;

wherein the plenum chamber is formed around at least a rear portion of said barrel.

13. The gas-powered gun according to claim 12, wherein the plenum is formed coaxially around the barrel.

14. The gas-powered gun according to claim 12, wherein the plenum is formed by a sleeve surrounding the barrel, said sleeve being sealed in either end by a front sealing and a rear sealing, said rear sealing formed with a passage providing a fluid connection between the plenum and the pressure chamber.

15. The gas-powered gun according to claim 14, wherein the sleeve is arranged coaxially around the barrel.

16. The gas-powered gun according to claim 12, wherein the source of pressurized air is a bottle containing compressed air which has been fitted to the gas-powered gun.

17. The gas-powered gun according to claim 12, further comprising an open-close valve connecting the pressure chamber to a space immediately behind a firing position in the barrel.

18. The gas-powered gun according to claim 17, further comprising a trigger which is mechanically connected to a spring-loaded hammer, which hammer is configured to operate the open-close valve.

19. The gas-powered gun according to claim 17, wherein the hammer is biased towards the open-close valve by a biasing spring, and is held against the force of the biasing spring by a catch, and wherein the trigger is operable to release the catch.

20. The gas-powered gun according to claim 17, further comprising a feeder pin arranged in a housing behind the barrel, said feeder pin being operable between a rearwards position, in which it allows a bullet to be inserted in a space in front of the feeder pin, and a forwards position in which it pushes the bullet into the firing position.

21. The gas-powered gun according to claim 14, wherein walls of the sleeve have a thickness of around 3 mm.

22. A gas-powered gun for discharge of projectiles, comprising:

a barrel;

a pressure chamber for holding compressed gas;

a valve arranged to release compressed gas from the pressure chamber to thereby discharge a projectile provided in the barrel;

a plenum chamber connected to said pressure chamber via a passage;

a bottle fitted to the gas-powered gun and containing pressurized air, said bottle being a source of pressurized air, wherein the plenum chamber is formed around at least a rear portion of said barrel.

* * * * *